US009454100B2

(12) United States Patent
Inoue et al.

(10) Patent No.: US 9,454,100 B2
(45) Date of Patent: Sep. 27, 2016

(54) DEVELOPER GUIDE DEVICE AND IMAGE FORMING APPARATUS INCLUDING THE SAME

(71) Applicant: KYOCERA Document Solutions Inc., Osaka-shi, Osaka (JP)

(72) Inventors: Toshiaki Inoue, Osaka (JP); Koji Murata, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/946,663

(22) Filed: Nov. 19, 2015

(65) Prior Publication Data

US 2016/0147181 A1 May 26, 2016

(30) Foreign Application Priority Data

Nov. 20, 2014 (JP) ..... 2014-235807

(51) Int. Cl.
*G03G 15/00* (2006.01)
*G03G 15/08* (2006.01)

(52) U.S. Cl.
CPC ..... *G03G 15/0879* (2013.01); *G03G 15/0848* (2013.01); *G03G 2215/0897* (2013.01)

(58) Field of Classification Search
CPC ..... G03G 15/095; G03G 15/0865; G03G 15/0877; G03G 15/0879; G03G 15/0862; G03G 15/0872; G03G 15/0831; G03G 15/0887; G03G 15/0889; G03G 15/0839
USPC ..... 399/2, 27, 120, 258, 260, 263
See application file for complete search history.

(56) References Cited

U.S. PATENT DOCUMENTS

2012/0020683 A1* 1/2012 Miura ..... G03G 15/0862 399/27

FOREIGN PATENT DOCUMENTS

JP 2004354524 A * 12/2004
JP 2013057849 A 3/2013

* cited by examiner

*Primary Examiner* — Walter L Lindsay, Jr.
*Assistant Examiner* — Jessica L Eley
(74) *Attorney, Agent, or Firm* — Alleman Hall McCoy Russell & Tuttle LLP

(57) ABSTRACT

A developer guide device includes a conveying pipe portion, a light-emitting portion, a light-receiving portion, and a cleaning mechanism. The conveying pipe portion is configured to guide a developer in a predetermined conveyance direction. The light-emitting portion is configured to emit light into an interior of the conveying pipe portion through a light projection window provided in a peripheral wall of the conveying pipe portion. The light-receiving portion is capable of receiving light from the interior of the conveying pipe portion through a light reception window provided in the peripheral wall of the conveying pipe portion. The cleaning mechanism includes a cleaning member configured to receive a predetermined drive force to be displaced thereby to come into contact with inner surfaces of the light projection window and the light reception window to clean the inner surfaces.

9 Claims, 8 Drawing Sheets

DEVELOPER GUIDE DEVICE AND IMAGE FORMING APPARATUS INCLUDING THE SAME

INCORPORATION BY REFERENCE

This application is based upon and claims the benefit of priority from the corresponding Japanese Patent Application No. 2014-235807 filed on Nov. 20, 2014, the entire contents of which are incorporated herein by reference.

BACKGROUND

The present disclosure relates to a developer guide device which supplies a developer from a developer storage container to a developing device, and an image forming apparatus including the developer guide device.

Conventionally, an image forming apparatus including an intermediate hopper on a conveyance path for a developer between a developer storage container and a developing device is known. In such a type of an image forming apparatus, the intermediate hopper is fixed to an apparatus main body, and the developer storage container and the developing device are detachable from the apparatus main body.

The intermediate hopper is able to temporarily store the developer supplied from the developer storage container while supplying the developer to the developing device. Thus, the provision of the intermediate hopper allows the developer storage capacity of the developing device, which is detachable from the apparatus main body, to be decreased by an amount of the developer stored temporarily. In addition, even if the developer storage container becomes empty, printing of a certain number of sheets can be performed.

Meanwhile, the intermediate hopper may be provided with an optical sensor which detects the developer within the intermediate hopper. The optical sensor includes a light-emitting portion and a light-receiving portion. If the developer is not detected by the optical sensor, it is determined that the developer is not present in the developer storage container.

SUMMARY

A developer guide device according to one aspect of the present disclosure includes a conveying pipe portion, a light-emitting portion, a light-receiving portion, and a cleaning mechanism. The conveying pipe portion is configured to guide a developer in a predetermined conveyance direction. The light-emitting portion is configured to emit light into an interior of the conveying pipe portion through a light projection window provided in a peripheral wall of the conveying pipe portion. The light-receiving portion is capable of receiving light from the interior of the conveying pipe portion through a light reception window provided in the peripheral wall of the conveying pipe portion. The cleaning mechanism includes a cleaning member configured to receive a predetermined drive force to be displaced thereby to come into contact with inner surfaces of the light projection window and the light reception window to clean the inner surfaces.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
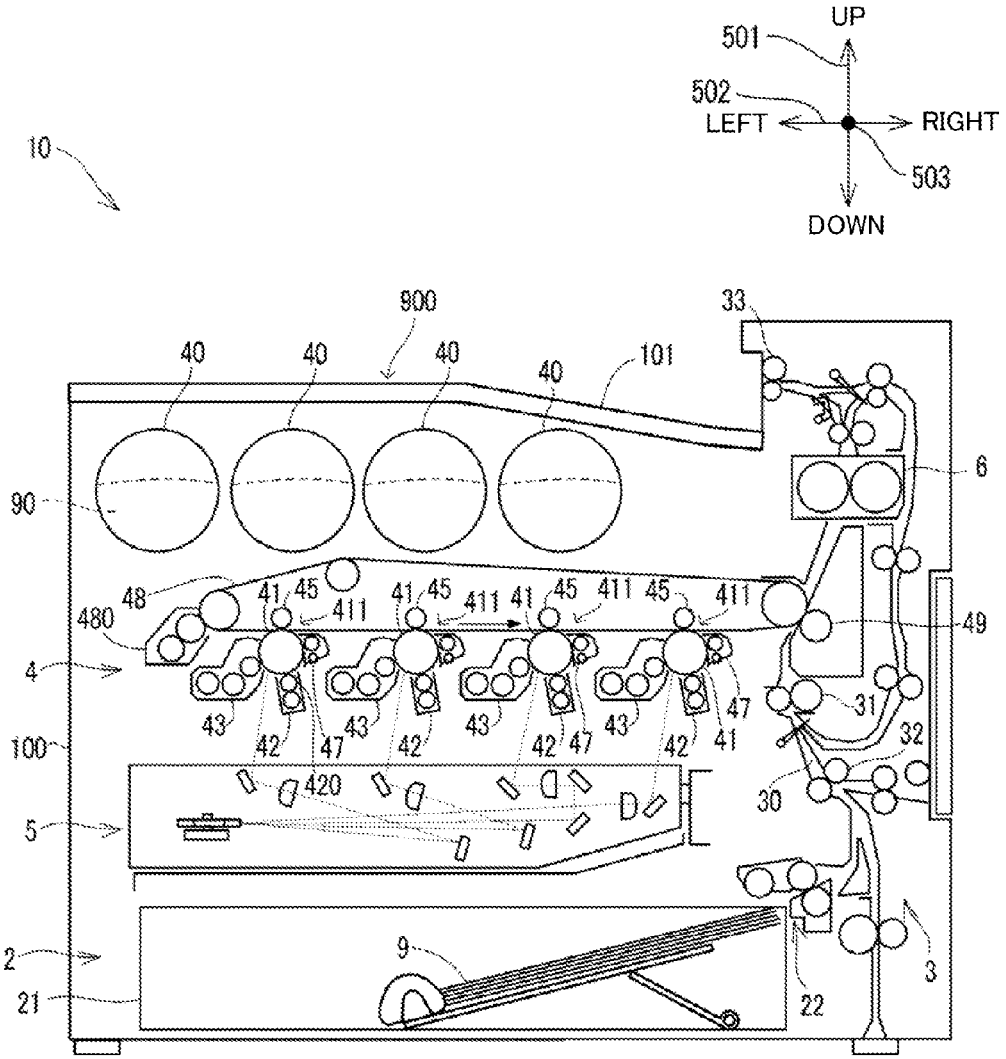
FIG. 1 is a schematic diagram showing the configuration of an image forming apparatus according to a first embodiment of the present disclosure.

Hereinafter, embodiments of the present disclosure will be described with reference to the accompanying drawings.

First, the configuration of an image forming apparatus 10 according to a first embodiment of the present disclosure will be described with reference to FIG. 1. In the following description, an up-down direction 501 is defined on the basis of a state where the image forming apparatus 10 is installed on a flat plane. A right-left direction 502 is defined by the image forming apparatus 10 being viewed from the near side (front surface side). A direction orthogonal to the drawing plane of FIG. 1 is defined as a front-rear direction 503.

As shown in FIG. 1, the image forming apparatus 10 includes a sheet feed portion 2, a sheet conveying portion 3, an image forming portion 4, an optical scanning portion 5, a fixing portion 6, and a container mounting portion 900, etc. within a housing 100.

The image forming apparatus 10 shown in FIG. 1 is a color printer and is connected to another communication apparatus in a communicable manner. The other communication apparatus is, for example, a personal computer. The image forming apparatus 10 executes an image forming job requested from the other communication apparatus.

The image forming apparatus 10 is a tandem-type image forming apparatus. Thus, the image forming portion 4 further includes an intermediate transfer belt 48, a cleaning device 480, and a secondary transfer device 49.

The image forming portion 4 includes a plurality of single-color image forming portions 411 corresponding to colors of cyan, magenta, yellow, and black, respectively.

Each single-color image forming portion 411 includes a photosensitive drum 41 which carries a toner image, a charging device 42, a developing device 43, a primary transfer device 45, and a cleaning device 47, etc. An electrostatic latent image is formed on the photosensitive drum 41 and converted into a manifest image by toner supplied from the developing device 43. The developing device 43 is an example of a developing portion of the present disclosure. The primary transfer device 45 and the secondary transfer device 49 transfer, onto a sheet member 9, the toner image formed on the photosensitive drum 41. The cleaning device 47 removes, from the photosensitive drum 41, the toner remaining on the photosensitive drum 41 after the transfer process performed by the primary transfer device 45.

Each photosensitive drum 41 rotates at a circumferential speed corresponding to the circumferential speed (movement speed) of the intermediate transfer belt 48. As the photosensitive drum 41, for example, an organic photosensitive member or an amorphous silicon photosensitive member may be used.

In each single-color image forming portion 411, the photosensitive drum 41 rotates, and the charging device 42 uniformly charges the surface of the photosensitive drum 41. Further, the optical scanning portion 5 performs scanning with laser light, thereby writing an electrostatic latent image on the charged surface of the photosensitive drum 41.

The developing device 43 develops the electrostatic latent image by supplying the toner to the photosensitive drum 41. The developing device 43 in the present embodiment charges the toner by agitating a two-component developer 90 which includes the toner and a carrier, and supplies the charged toner to the photosensitive drum 41. The developing device 43 is detachable from the housing 100 of the image forming apparatus 10.

The developing device 43 is provided with a density sensor 425 (see FIG. 4) for detecting a toner density in the two-component developer 90. An output signal of the density sensor 425 is outputted to a control portion 700 described later.

The charging device 42 includes a charging roller 420 which charges a portion of the photosensitive drum 41 on which portion the electrostatic latent image has not yet been written.

The intermediate transfer belt 48 is an endless belt-like member formed in a loop shape. The intermediate transfer belt 48 rotates in a state of being extended on and between two rollers. In the image forming portion 4, each single-color image forming portion 411 forms an image of the color thereof on the surface of the intermediate transfer belt 48. Thus, a color image in which the images of the respective colors are superposed is formed on the intermediate transfer belt 48.

The secondary transfer device 49 transfers, onto the sheet member 9, the toner image formed on the intermediate transfer belt 48. The cleaning device 480 removes the toner remaining on a portion of the intermediate transfer belt 48 which portion has passed through the secondary transfer device 49.

The sheet feed portion 2 includes a sheet receiving portion 21 and a sheet sending-out portion 22. The sheet receiving portion 21 is configured to allow a plurality of sheet members 9 to be placed in a stacked manner thereon. The sheet members 9 are sheet-like media on which an image is to be formed, such as paper, coated paper, postcards, envelopes, OHP sheets, and the like.

The sheet sending-out portion 22 rotates in contact with the sheet member 9 to send out the sheet member 9 from the sheet receiving portion 21 toward a conveyance path 30.

The sheet conveying portion 3 includes registration rollers 31, conveying rollers 32, and discharge rollers 33, etc. The registration rollers 31 and the conveying rollers 32 convey the sheet member 9 fed from the sheet feed portion 2 toward the secondary transfer device 49 of the image forming portion 4. Furthermore, the discharge rollers 33 discharge the sheet member 9 on which an image has been formed, through a discharge port of the conveyance path 30 onto a discharge tray 101.

A top cover which is not shown is provided at an upper portion of the housing 100 and is supported so as to be able to be opened and closed about a support shaft (not shown) of the housing 100. When the top cover is rotated upward (in an opening direction), the container mounting portion 900 is exposed.

The container mounting portion 900 is provided above the image forming portion 4. The container mounting portion 900 is able to house therein toner containers 40 from which cyan toner, magenta toner, yellow toner, and black toner are supplied to the developing devices 43, respectively. Each toner container 40 is mounted so as to be housed in the container mounting portion 900, and is detachable from the container mounting portion 900.

The respective toner containers 40 are provided in corresponding relation to the respective single-color image forming portions 411 of the image forming portion 4. Each toner container 40 contains the toner to be supplied to the corresponding developing device 43 of the image forming portion 4. The toner containers 40 contain the toners of the colors corresponding to the respective colors of the image forming portion 4. Specifically, the respective toner containers 40 individually contain the black toner, the cyan toner, the magenta toner, and the yellow toner.

In the present embodiment, each toner container 40 includes a container body (not shown) having a cylindrical shape. A helical rib (not shown) is formed on the inner wall surface of the container body.

The container body is rotated about an axis thereof by a drive motor which is not shown. When the toner container 40 is rotated, the toner contained within the container body gradually moves along an axial direction due to displacement of the rib. A toner discharge port (not shown) is provided at a downstream side in a moving direction in which the toner moves, and the toner within the container body is discharged through the toner discharge port (not shown). The moving direction in which the toner moves in the toner container 40 is a direction from the rear surface of FIG. 1 toward the front surface of FIG. 1, and the toner discharge port is provided at the near side with respect to the intermediate transfer belt 48 in FIG. 1.

Figure 2:
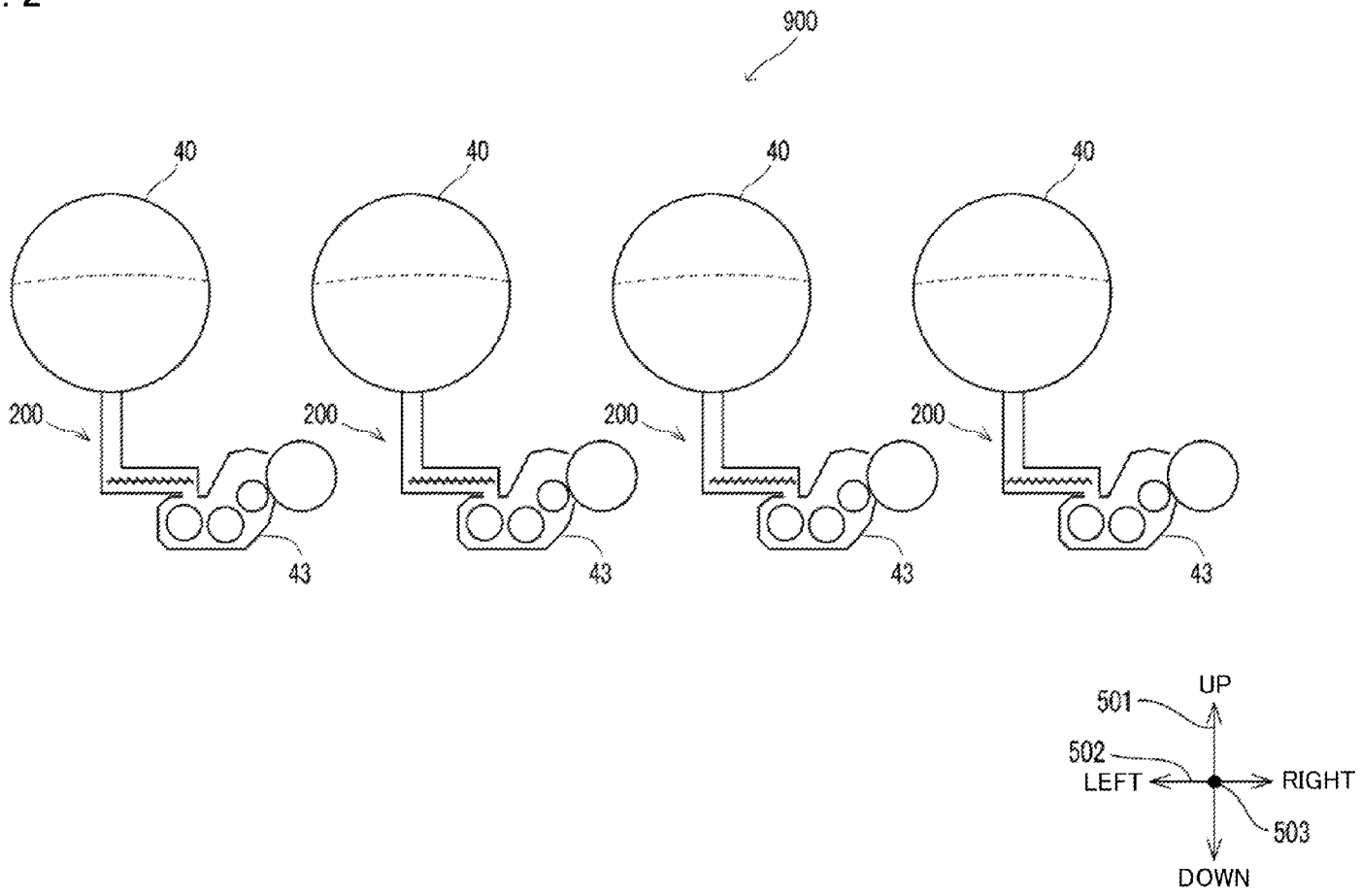
FIG. 2 illustrates a toner conveying device provided between each toner container and each developing device.

As shown in FIG. 2, the image forming apparatus 10 includes a toner conveying device 200 between each toner container 40 and the developing device 43 corresponding to the toner container 40. The toner conveying device 200 guides, to the developing device 43, the toner supplied from the toner container 40. The toner conveying device 200 is an example of a developer guide device of the present disclosure. Each toner container 40 is an example of a developer storage portion of the present disclosure.

Figure 3:
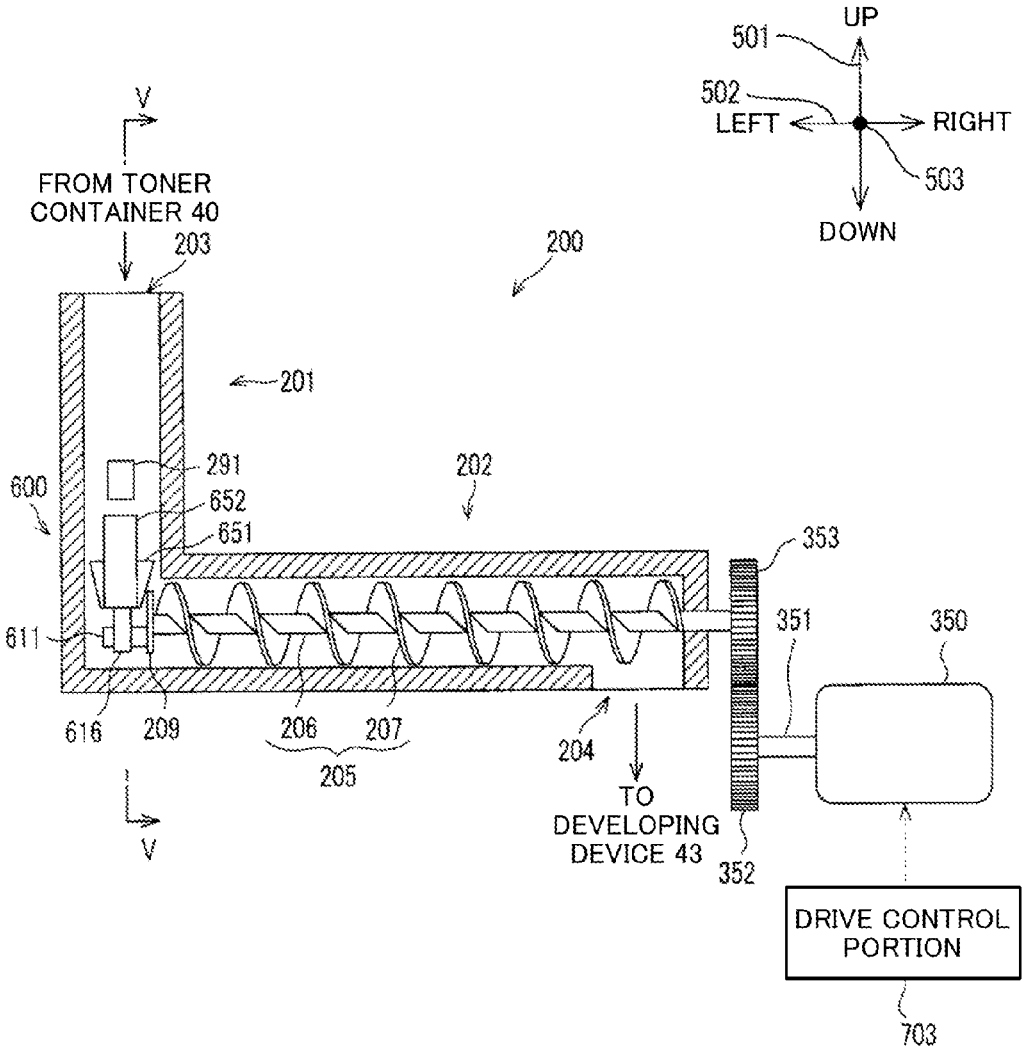
FIG. 3 is a cross-sectional view showing the configuration of the toner conveying device.

Specifically, as shown in FIG. 3, the toner conveying device 200 includes: a vertical pipe portion 201 extending in the up-down direction 501; and a horizontal pipe portion 202 extending in a horizontal direction. The vertical pipe portion 201 is referred to also as an intermediate hopper. Each of the vertical pipe portion 201 and the horizontal pipe portion 202 has a tubular shape. In the present embodiment, each of the vertical pipe portion 201 and the horizontal pipe portion 202 has a cylindrical shape.

The upper end of the vertical pipe portion 201 has a toner reception port 203 which communicates with the toner discharge port of the toner container 40. The toner discharged from the toner container 40 enters the vertical pipe portion 201 through the toner reception port 203. The toner having entered the vertical pipe portion 201 drops in the interior of the vertical pipe portion 201. In this manner, the toner container 40 is able to contain the toner and supply the toner to the vertical pipe portion 201 of the toner conveying device 200.

The horizontal pipe portion 202 is connected at one end portion (an end portion at the left side in FIG. 3) thereof to the lower end of the vertical pipe portion 201, so that the interior of the horizontal pipe portion 202 communicates with the interior of the vertical pipe portion 201.

A screw member 205 is provided within the horizontal pipe portion 202 so as to extend along the longitudinal direction of the horizontal pipe portion 202. The screw member 205 conveys the toner within the horizontal pipe portion 202. The screw member 205 is a member including a helical blade 207 around an elongated shaft body 206 extending along the longitudinal direction of the horizontal pipe portion 202. The screw member 205 is an example of a conveying member of the present disclosure.

The image forming apparatus 10 includes a drive motor 350 (see FIGS. 3 and 4) which rotationally drives the screw member 205, and rotational power of the drive motor 350 is transmitted to the screw member 205. Specifically, a drive gear 352 is mounted on a motor shaft 351 of the drive motor 350. In addition, the shaft body 206 of the screw member 205 projects outward from the horizontal pipe portion 202, and a drive gear 353 is mounted on a projecting end portion (an end portion at the right side in FIG. 3) of the shaft body 206. The drive gear 352 and the drive gear 353 are in mesh with each other. Thus, the screw member 205 is rotationally driven by the drive motor 350. When the screw member 205 is rotationally driven, the toner within the horizontal pipe portion 202 is conveyed to the downstream side (the right side in FIG. 3). A moving direction in which the toner moves in the horizontal pipe portion 202 is a direction from the front surface of FIG. 1 toward the rear surface of FIG. 1. The screw member 205 conveys the toner having passed through the vertical pipe portion 201. The shaft body 206 is an example of a rotation shaft of the present disclosure.

In this manner, the vertical pipe portion 201 guides the toner in the up-down direction 501, and the horizontal pipe portion 202 guides the toner in the right-left direction 502. The vertical pipe portion 201 is an example of a conveying pipe portion of the present disclosure.

A toner supply port 204 is provided near the downstream end (the right end in FIG. 3) of the horizontal pipe portion 202. The toner conveyed by the screw member 205 is discharged through the toner supply port 204.

A toner introduction port (not shown) provided in the developing device 43 communicates with the toner supply port 204. The toner conveyed in the horizontal pipe portion 202 is supplied through the toner introduction port to the interior of the developing device 43.

The toner conveying device 200 is able to temporarily store the toner supplied from the toner container 40 while supplying the toner to the developing device 43. Due to the provision of the toner conveying device 200, the toner storage capacity of the developing device 43, which is detachable from the housing 100 of the image forming apparatus 10, is reduced by an amount of the toner stored in the toner conveying device 200.

If the toner remains in the toner container 40, the interior of the vertical pipe portion 201 and the interior of the horizontal pipe portion 202 are filled with the toner. In addition, if the toner becomes absent in the toner container 40, the toner is no longer supplied from the toner container 40 to the vertical pipe portion 201 and the horizontal pipe portion 202, but the toner remains within the vertical pipe portion 201 and the horizontal pipe portion 202 for a while. The provision of the toner conveying device 200 allows printing of a certain number of sheets to be performed even if the toner container 40 becomes empty. Along with supply of the toner to the developing device 43, the amount of the toner within the vertical pipe portion 201 and the horizontal pipe portion 202 gradually decreases.

Figure 5:
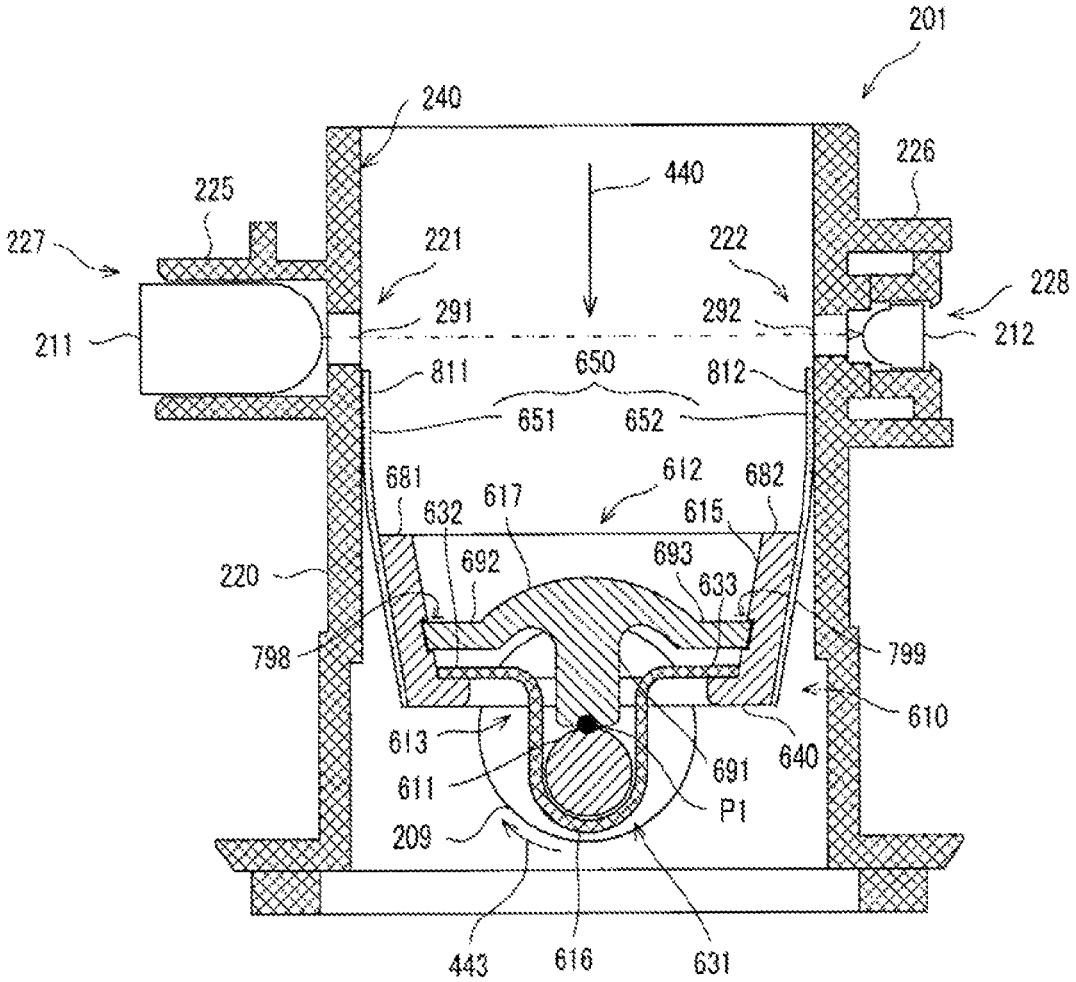
FIG. 5 is a cross-sectional view, as seen from the direction of arrows V-V in FIG. 3, showing the configuration of a cleaning mechanism.

As shown in FIG. 5, the vertical pipe portion 201 is provided with an optical sensor 210.

The optical sensor 210 includes a light-emitting portion 211 and a light-receiving portion 212. The light-emitting portion 211 is composed of, for example, a light-emitting diode. The light-receiving portion 212 is composed of, for example, a phototransistor. In the present embodiment, the optical sensor 210 is a transmission type optical sensor. A light projection window 221 and a light reception window 222 are provided at predetermined height positions in a peripheral wall 220 of the vertical pipe portion 201. Each of the light projection window 221 and the light reception window 222 is formed from a resin which transmits light. The light projection window 221 and the light reception window 222 are provided in the peripheral wall 220 of the vertical pipe portion 201 and at positions opposed to each other.

The peripheral wall 220 of the vertical pipe portion 201 is provided with a first mounting portion 225 and a second mounting portion 226.

The first mounting portion 225 is a tubular portion standing on a portion of the peripheral wall 220 which portion surrounds the light projection window 221. A first recess portion 227 is formed by the first mounting portion 225 and the peripheral wall 220 of the vertical pipe portion 201. The light-emitting portion 211 is fitted in the first recess portion 227.

The second mounting portion 226 is a tubular portion standing on a portion of the peripheral wall 220 which portion surrounds the light reception window 222. A second recess portion 228 is formed by the second mounting portion 226 and the peripheral wall 220 of the vertical pipe portion 201. The light-receiving portion 212 is fitted in the second recess portion 228.

The light-emitting portion 211 is provided in the first recess portion 227 so as to emit light through the light projection window 221 into the interior of the vertical pipe portion 201. The light-receiving portion 212 is able to receive light from the interior of the vertical pipe portion 201 through the light reception window 222.

In the present embodiment, the optical sensor 210 is a transmission type optical sensor in which the light-emitting portion 211 emits light toward the light-receiving portion 212. That is, the light-emitting portion 211 and the light-receiving portion 212 are provided such that direct light which is the light outputted from the light-emitting portion 211 is incident on the light-receiving portion 212.

If the vertical pipe portion 201 and the horizontal pipe portion 202 are filled with the toner, the toner is present on a light path between the light-emitting portion 211 and the light-receiving portion 212. Thus, the light (direct light) emitted from the light-emitting portion 211 is shielded by the toner and is not received by the light-receiving portion 212. At this time, the signal level of an output signal from the light-receiving portion 212 becomes lower than a predetermined first threshold.

On the other hand, if the toner remaining within the vertical pipe portion 201 and the horizontal pipe portion 202 gradually reduces such that the toner disappears from the light path between the light-emitting portion 211 and the light-receiving portion 212, the light (direct light) emitted from the light-emitting portion 211 reaches the light-receiving portion 212 and is received by the light-receiving portion 212. At this time, the amount of the light received by the light-receiving portion 212 becomes equal to or greater than that equivalent to a threshold, and the signal level of the output signal from the light-receiving portion 212 becomes equal to or higher than the first threshold.

The control portion 700 described later determines whether the signal level of the output signal from the light-receiving portion 212 is lower than the first threshold, thereby determining whether the toner is present in the toner container 40.

Meanwhile, even if the toner becomes absent in the toner container 40 and the amount of the toner remaining in the vertical pipe portion 201 becomes such an amount that the toner does not reach the height position of the light projection window 221 or the light reception window 222, the toner may continuously adhere to an inner surface 291 of the light projection window 221 or an inner surface 292 of the light reception window 222. In this case, the light outputted from the light-emitting portion 211 is shielded by the toner that adheres to the inner surface 291 or the inner surface 292.

If such a state occurs, even though the interior of the vertical pipe portion 201 or the toner container 40 is empty, the signal level of the output signal from the light-receiving portion 212 is lower than the first threshold as in the case where the vertical pipe portion 201 and the toner container 40 are filled with the toner. If the control portion 700 obtains this output signal, since the signal level of the output signal is lower than the first threshold due to the toner adhering to the inner surface 291 or 292, it is falsely determined that the toner remains in the toner container 40. That is, the determination, using the output signal from the optical sensor 210, as to whether the toner is present in the toner container 40 is not accurately performed. The image forming apparatus 10 of the present embodiment has the following configuration in order to prevent occurrence of such a problem.

The image forming apparatus 10 includes a cleaning mechanism 600. The cleaning mechanism 600 removes the toner adhering to the inner surfaces 291 and 292 of the light projection window 221 and the light reception window 222, thereby cleaning the inner surfaces 291 and 292. The cleaning mechanism 600 includes a power transmission portion 610 and a cleaning member 650.

The power transmission portion 610 transmits rotational power of the screw member 205 to the cleaning member 650 to displace the cleaning member 650. The power transmission portion 610 includes an eccentric shaft portion 611 and a connection portion 612.

The eccentric shaft portion 611 is a short shaft body. The eccentric shaft portion 611 is mounted on the screw member 205 so as to extend parallel to the shaft body 206 of the screw member 205.

A disk portion 209 is provided on an upstream side end portion of the screw member 205. The disk portion 209 is integrally connected to the upstream side end portion of the shaft body 206 of the screw member 205. Thus, when the screw member 205 rotates, the disk portion 209 also rotates. The position where the shaft body 206 of the screw member 205 and the disk portion 209 are connected to each other is the center position of the disk portion 209. Thus, a rotation center P1 of the disk portion 209 is the position where the disk portion 209 and the shaft body 206 are connected to each other.

The eccentric shaft portion 611 is mounted on a surface of the disk portion 209 which surface is opposite to a surface of the disk portion 209 to which the shaft body 206 is connected. The position at which the eccentric shaft portion 611 is mounted is a position eccentric from the rotation center P1, that is, a position away from the center position of the disk portion 209 by a predetermined distance. Therefore, the eccentric shaft portion 611 rotates around the rotation center P1 with rotation of the screw member 205. In the present embodiment, a direction in which the eccentric shaft portion 611 rotates is the direction of an arrow 443. On the basis of the predetermined distance, a moving amount of the cleaning member 650 in a conveyance direction 440 and a direction 441 opposite to the conveyance direction 440 is determined.

Figure 6:
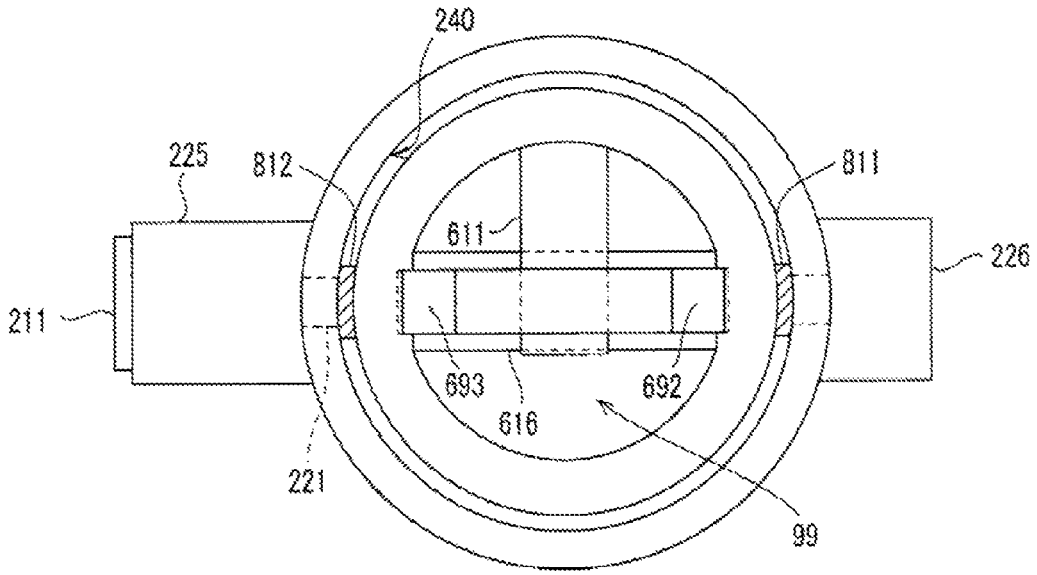
FIG. 6 is a view of the cleaning mechanism as seen from above.

The connection portion 612 is provided within the vertical pipe portion 201. The connection portion 612 includes a base 615, an engagement member 616, and a locking pin 617. The base 615 is provided above the eccentric shaft portion 611. The base 615 includes a bottom portion 640, a first support portion 681, and a second support portion 682. The bottom portion 640 has a plate shape long in one direction, and extends horizontally in a direction from the light-emitting portion 211 side toward the light-receiving portion 212 side as shown also in FIG. 6. The first support portion 681 extends toward the upstream side in the conveyance direction 440 (see FIG. 5) of the toner in the vertical pipe portion 201 so as to be inclined from an end portion of the bottom portion 640 at the light-emitting portion 211 side toward an inner circumferential surface 240 of the vertical pipe portion 201, and supports a later-described first contact member 651 at the side including the light projection window 221. The second support portion 682 extends toward the upstream side in the conveyance direction 440 so as to be inclined from an end portion of the bottom portion 640 at the light-receiving portion 212 side toward the inner circumferential surface 240 of the vertical pipe portion 201, and supports a later-described second contact member 652 at the side including the light reception window 222. That is, the base 615 has a circular truncated cone shape and is provided in such an attitude that the base 615 widens toward the upstream side. In addition, the bottom portion 640 of the connection portion 612 is provided with a circular opening 613.

The engagement member 616 is molded from a narrow plate-like member as a material and includes a center portion 631 and projection portions 632 and 633. The center portion 631 has a U shape. The projection portion 632 projects from one end portion of the center portion 631 in an outward direction opposite to the center portion 631, and the projection portion 633 projects from the other end portion of the center portion 631 in an outward direction opposite to the center portion 631.

The center portion 631 projects downward from the opening 613 of the connection portion 612. The projection portions 632 and 633 are in contact with the bottom portion 640 of the base 615 within the base 615 to be engaged with the bottom portion 640 of the base 615. The eccentric shaft portion 611 is rotatably supported by the center portion 631.

The locking pin 617 serves to fix the base 615 to the eccentric shaft portion 611 such that the base 615 is prevented from being pulled out downward relative to the eccentric shaft portion 611, while pressing the projection portions 632 and 633 against the bottom portion 640. The locking pin 617 is provided within the base 615. The locking pin 617 includes a projection portion 691, a first locking portion 692, and a second locking portion 693. The projection portion 691 projects downward and has a lower end in contact with the eccentric shaft portion 611. The first locking portion 692 extends from the upper end of the projection portion 691 toward the first support portion 681 side. The second locking portion 693 extends from the upper end of the projection portion 691 toward the second support portion 682 side. Locking recesses 798 and 799 are formed in the inner circumferential surface of the base 615, and the locking pin 617 is engaged with the locking recesses 798 and 799. In mounting the locking pin 617, since the locking pin 617 is formed from a resin, the locking pin 617 is inserted into the interior of the base 615 while deforming. When the distal end of the first locking portion 692 is fitted into the locking recess 798 and the distal end of the second locking portion 693 is fitted into the locking recess 799, the locking pin 617 returns to the original shape. Thus, the base 615 is prevented from being pulled out. The connection portion 612 is connected to the eccentric shaft portion 611 at the center of the bottom portion 640 of the connection portion 612.

The toner supplied from the toner container 40 to the vertical pipe portion 201 enters the horizontal pipe portion 202 through a gap 99 which is formed by the base 615, the engagement member 616, and the locking pin 617.

Upon rotation of the screw member 205, the disk portion 209 rotates, and the eccentric shaft portion 611 rotates around the rotation center P1. The connection portion 612, which is connected to the eccentric shaft portion 611, receives a force from the eccentric shaft portion 611 that rotates around the rotation center P1, to reciprocate in the conveyance direction 440 and the opposite direction 441.

The cleaning member 650 comes into contact with the inner surfaces 291 and 292 of the light projection window 221 and the light reception window 222 to clean the inner surfaces 291 and 292.

The cleaning member 650 includes the first contact member 651 and the second contact member 652. Each of the first contact member 651 and the second contact member 652 is a sheet-like elastic member having elasticity and light-shielding properties.

The first contact member 651 and the second contact member 652 are mounted on the outer circumferential surface of the base 615 and at positions corresponding to the light projection window 221 and the light reception window 222, respectively. That is, the first contact member 651 is mounted on the outer circumferential surface of the first support portion 681 by means of an adhesive or a fixing tool such as a screw and provided in corresponding relation to the inner surface 291 of the light projection window 221, and the second contact member 652 is mounted on the outer circumferential surface of the second support portion 682 by means of an adhesive or a fixing tool such as a screw and provided in corresponding relation to the inner surface 292 of the light reception window 222.

The first contact member 651 and the second contact member 652 include projection portions 811 and 812, respectively, projecting upward from an upper edge portion of the outer circumferential surface of the connection portion 612.

As described above, the connection portion 612 is connected at one end thereof to the cleaning member 650 and at the other end thereof to the eccentric shaft portion 611.

The first contact member 651 and the second contact member 652 are in contact with the inner circumferential surface 240 of the vertical pipe portion 201 including the inner surfaces 291 and 292, in a bent state.

The present disclosure is not limited to the configuration in which the first contact member 651 and the second contact member 652 are mounted on the outer circumferential surfaces of the first support portion 681 and the second support portion 682. The support portion of the present disclosure can have any configuration as long as the support portion supports the first contact member 651 and the second contact member 652 in a bent state such that the first contact member 651 and the second contact member 652 project upward so as to be contactable with the inner circumferential surface 240 of the vertical pipe portion 201 including the inner surfaces 291 and 292.

Figure 4:
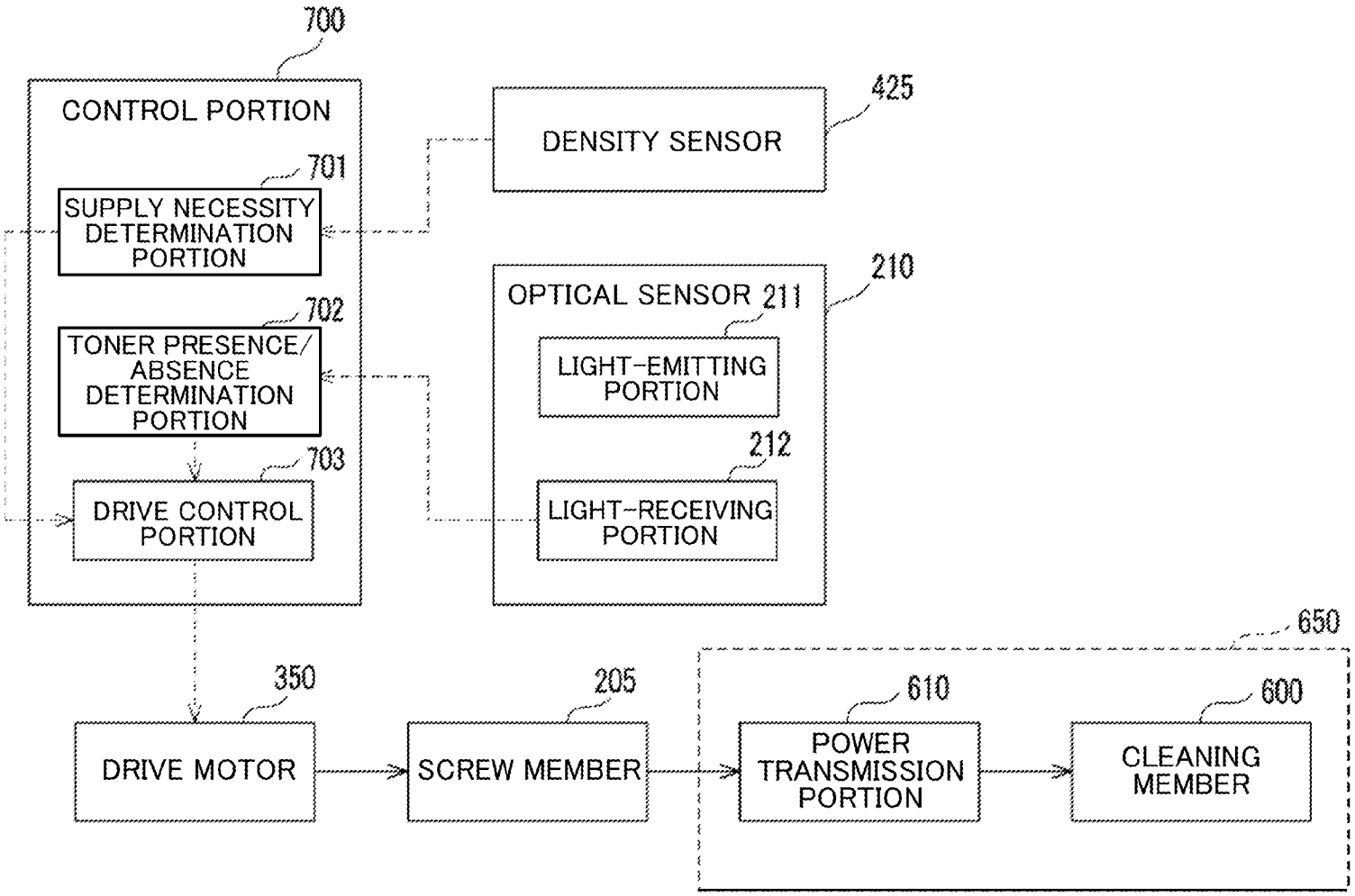
FIG. 4 is a block diagram showing the configuration of the image forming apparatus according to the first embodiment of the present disclosure.

As shown in FIG. 4, when the drive motor 350 is rotationally driven, the screw member 205 rotates. When the screw member 205 rotates, rotational power of the screw member 205 is transmitted via the power transmission portion 610 of the cleaning mechanism 600 to the cleaning member 650.

The power transmission portion 610 converts the rotational power of the screw member 205 to power in the conveyance direction 440 and the opposite direction 441 and transmits the power to the cleaning member 650. That is, the power transmission portion 610 causes the cleaning member 650 to reciprocate in the conveyance direction 440 and the opposite direction 441 in a state where the cleaning member 650 is in contact with the inner circumferential surface 240.

Accordingly, the first contact member 651 cleans the inner surface 291 of the light projection window 221 when coming into contact with the inner surface 291. In addition, the second contact member 652 cleans the inner surface 292 of the light reception window 222 when coming into contact with the inner surface 292.

The connection portion 612 has a section which comes into contact with the inner circumferential surface 240 of the vertical pipe portion 201 during the reciprocation in the conveyance direction 440 and the opposite direction 441. When the connection portion 612 comes into contact with the inner circumferential surface 240, the connection portion 612 receives a force from the peripheral wall 220, and the attitude (inclination) of the connection portion 612 changes by the received force and an elastic force of the cleaning member 650. The connection portion 612 can take four attitudes described below when the attitude of the connection portion 612 is roughly divided.

Figure 7B:
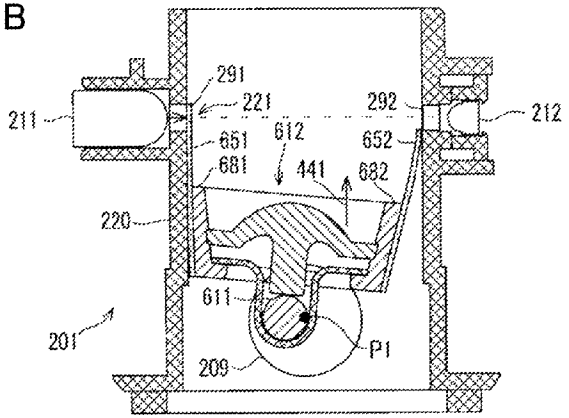
FIGS. 7A-7D show changes of the attitudes of a connection portion and a cleaning member.
Figure 7D:
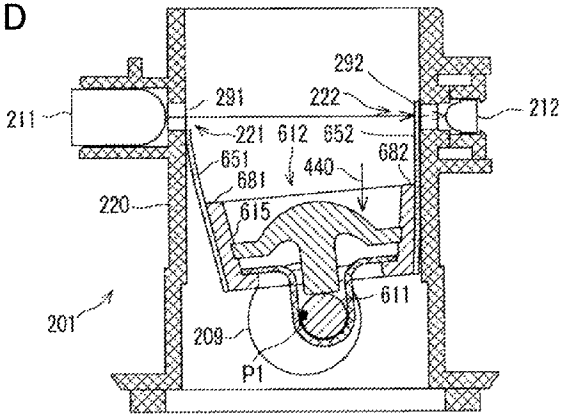
Figure 7A:
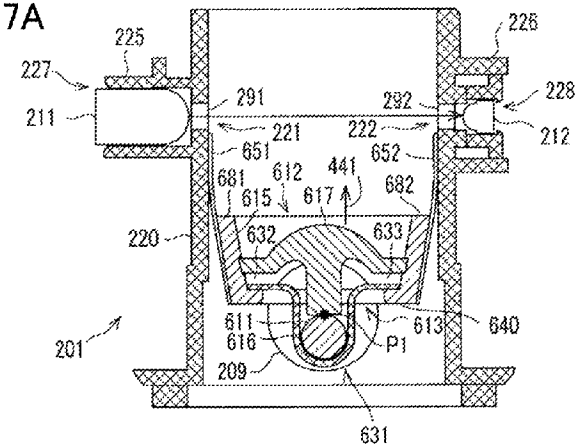

A first attitude is an attitude shown in FIG. 7(A). That is, the first attitude is an attitude in which the bottom portion 640 extends horizontally at a position most distant from the light path between the light-emitting portion 211 and the light-receiving portion 212. At this time, the first contact member 651 and the second contact member 652 retract from positions facing the inner surfaces 291 and 292.

A second attitude is an attitude shown in FIG. 7(B). That is, the second attitude is an attitude in which the first support portion 681 is in contact with the inner circumferential surface 240 of the vertical pipe portion 201 and the second support portion 682 is not in contact with the inner circumferential surface 240, so that the connection portion 612 is inclined such that the first support portion 681 is located at a position higher than that of the second support portion 682. At this time, the first contact member 651 faces the inner surface 291 of the light projection window 221, and the second contact member 652 retracts from the position facing the inner surface 292.

Figure 7C:
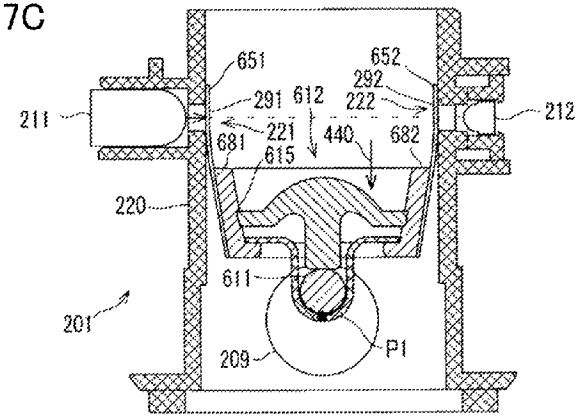

A third attitude is an attitude shown in FIG. 7(C). That is, the third attitude is an attitude in which the bottom portion 640 extends horizontally at a position closest to the light path between the light-emitting portion 211 and the light-receiving portion 212. At this time, the first contact member 651 and the second contact member 652 face the inner surfaces 291 and 292, respectively.

A fourth attitude is an attitude shown in FIG. 7(D). That is, the fourth attitude is an attitude in which the first support portion 681 is not in contact with the inner circumferential surface 240 of the vertical pipe portion 201 and the second support portion 682 is in contact with the inner circumferential surface 240, so that the connection portion 612 is inclined such that the second support portion 682 is located at a position higher than that of the first support portion 681. At this time, the second contact member 652 faces the inner surface 292 and the first contact member 651 retracts from the position facing the inner surface 291.

When the eccentric shaft portion 611 rotates around the rotation center P1 in the direction of the arrow 443, the attitude of the connection portion 612 changes in order of the first attitude, the second attitude, the third attitude, and the fourth attitude. In addition, the attitude of the connection portion 612 periodically changes such that after the fourth attitude, the first attitude is taken again and the attitude changes as described above.

As described above, the cleaning mechanism 600 displaces the cleaning member 650 in the conveyance direction 440 and the opposite direction 441 between a facing position at which the cleaning member 650 faces the inner surfaces 291 and 292 and a retracting position at which the cleaning member 650 has retracted from the facing position.

As shown in FIG. 4, the image forming apparatus 10 includes the control portion 700. The control portion 700 includes a CPU, a ROM, and a RAM.

The CPU is a processor which executes various calculation processes. The ROM is a non-volatile storage portion in which information such as a control program for causing the CPU to execute various processes is stored in advance. The RAM is a volatile storage portion which is used as a temporary storage memory (working area) for various processes executed by the CPU. The control portion 700 controls operation of the image forming apparatus 10 by the CPU executing the program stored in the ROM.

Figure 8:
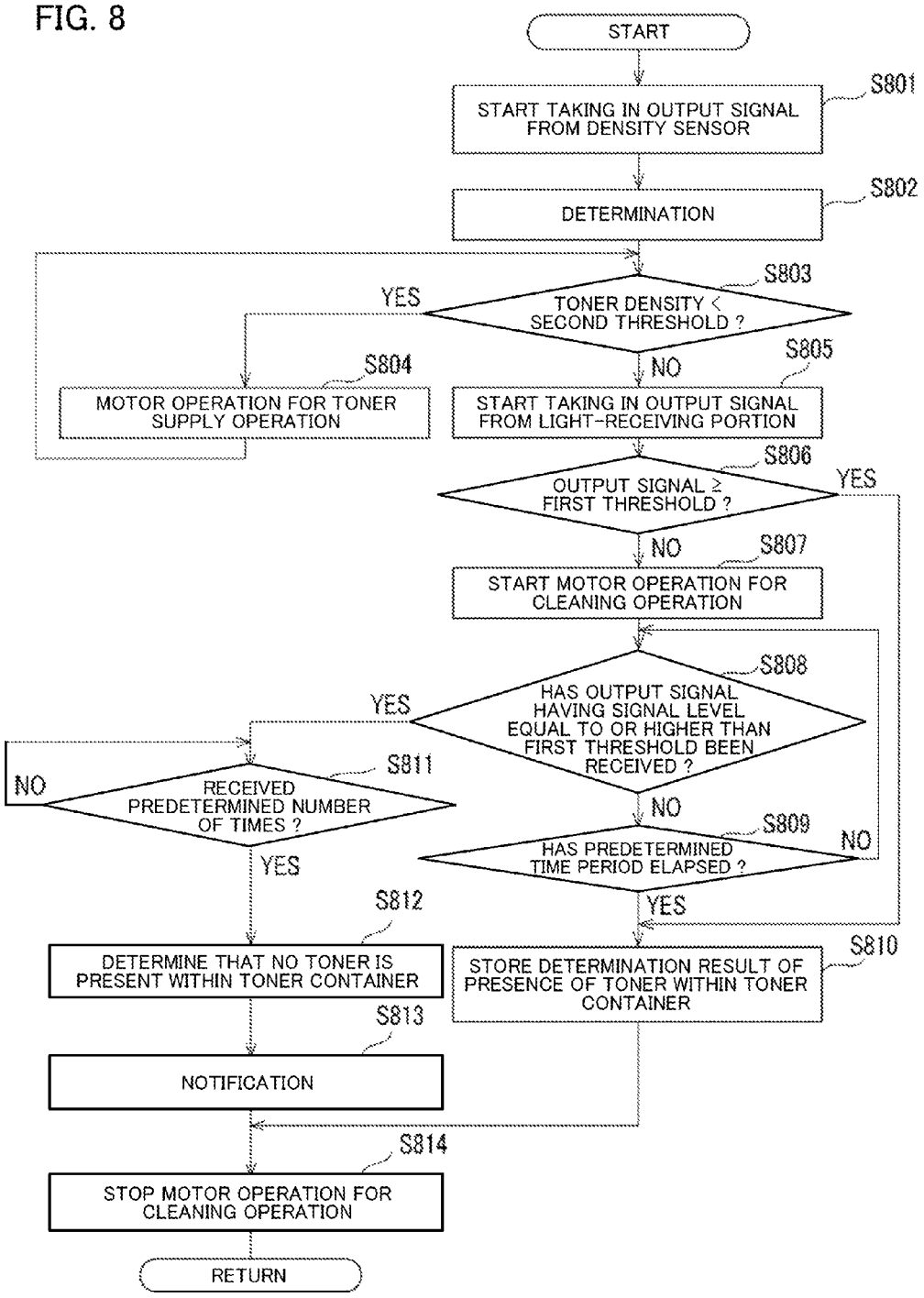
FIG. 8 is a flowchart showing control of a drive motor by a control portion.

In the ROM of the control portion 700, a processing program is stored which causes the CPU of the control portion 700 to execute a process described later (see a flowchart in FIG. 8). The processing program may be stored into the ROM at the time of shipment of the image forming apparatus 10. Alternatively, the processing program may be stored in a non-transitory computer-readable information storage medium such as a CD, a DVD, or a flash memory, and may be stored from the information storage medium into the ROM of the control portion 700 after the above shipment.

The control portion 700 includes a supply necessity determination portion 701, a toner presence/absence determination portion 702, and a drive control portion 703 by the CPU executing the processing program stored in the ROM. A configuration can be also used in which part or a plurality of functions of the control portion 700 are implemented as an electronic circuit. The toner presence/absence determination portion 702 corresponds to a developer determination portion of the present disclosure.

The supply necessity determination portion 701 determines whether the toner should be supplied to the developing device 43, on the basis of the output signal from the density sensor 425. That is, the supply necessity determination portion 701 determines whether a signal level indicated by the output signal is a second threshold indicating a toner density lower than a predetermined threshold. If so, the supply necessity determination portion 701 determines that the toner should be supplied to the developing device 43.

The toner presence/absence determination portion 702 determines whether the toner is present within the toner container 40. If the supply necessity determination portion 701 determines that the signal level is a level indicating a toner density equal to or higher than the second threshold, the toner presence/absence determination portion 702 determines whether the toner is present within the toner container 40, on the basis of the output signal from the light-receiving portion 212. That is, if the signal level of the output signal from the light-receiving portion 212 is a level equal to or higher than the first threshold, the toner presence/absence determination portion 702 determines that no toner is present within the toner container 40. In any case other than the above, the toner presence/absence determination portion 702 determines that the toner is present within the toner container 40. The process of the toner presence/absence determination portion 702 will be described later. The toner presence/absence determination portion 702 corresponds to a determination portion of the present disclosure.

The drive control portion 703 controls operation of the drive motor 350 which rotates the screw member 205.

The drive control portion 703 controls operation of the drive motor 350 on the basis of a determination result of the supply necessity determination portion 701. That is, if the supply necessity determination portion 701 determines that the toner should be supplied to the developing device 43, the drive control portion 703 causes the drive motor 350 (see FIG. 4) to operate to supply the toner to the developing device 43.

The drive control portion 703 also controls operation of the drive motor 350 on the basis of a determination result of the toner presence/absence determination portion 702. That is, if the toner presence/absence determination portion 702 determines that the toner container 40 is not empty, the drive control portion 703 causes the drive motor 350 (see FIG. 4) to operate to supply a drive force for causing the cleaning mechanism 600 to perform a cleaning operation.

After the operation of the drive motor 350 for the cleaning operation is started, if the toner presence/absence determination portion 702 determines that the toner container 40 is empty, the drive control portion 703 stops the operation of the drive motor 350 for the cleaning operation.

In the first attitude, the light outputted from the light-emitting portion 211 is received by the light-receiving portion 212. In the second attitude, the light outputted from the light-emitting portion 211 is shielded by the first contact member 651, which has light-shielding properties, and is not received by the light-receiving portion 212. In the third attitude, the light outputted from the light-emitting portion 211 is shielded by the first contact member 651 and the second contact member 652, which have light-shielding properties, and is not received by the light-receiving portion 212. In the fourth attitude, the light outputted from the light-emitting portion 211 is shielded by the second contact member 652 and is not received by the light-receiving portion 212.

Here, only in the first attitude among the four attitudes, the light outputted from the light-emitting portion 211 is received by the light-receiving portion 212, and an output signal having a signal level equal to or higher than the first threshold is outputted from the light-receiving portion 212.

In the present embodiment, the timing when the operation of the drive motor 350 for the cleaning operation is stopped after the operation is started is determined on the basis of the output signal which has a signal level equal to or higher than the first threshold and is outputted from the light-receiving portion 212 when the connection portion 612 is in the first attitude. Specifically, after the operation of the drive motor 350 for the cleaning operation is started, if the output signal having a signal level equal to or higher than the first threshold is received from the light-receiving portion 212 a predetermined number of times, the drive control portion 703 stops the operation of the drive motor 350 for the cleaning operation, that is, the cleaning operation performed by the cleaning mechanism 600.

After the cleaning is performed by the cleaning mechanism 600, if the output signal having a signal level equal to or higher than the first threshold is received from the light-receiving portion 212, the toner presence/absence determination portion 702 determines that the toner is not present within the vertical pipe portion 201 and the toner container 40.

Next, a process performed by the control portion 700 will be described with reference to FIG. 8. In the flowchart in FIG. 8, S801, S802, . . . represent process procedure (step) numbers.

<Step S801>

In step S801, for example, when the image forming apparatus 10 is started up, the supply necessity determination portion 701 starts taking in the output signal from the density sensor 425. Then, the control portion 700 performs a process in step S802.

<Step S802>

In step S802, the supply necessity determination portion 701 determines whether the signal level of the output signal from the density sensor 425 is a signal level indicating a toner density lower than the second threshold.

<Step S803>

If the supply necessity determination portion 701 determines that the signal level indicates a toner density lower than the second threshold (YES in step S803), the control portion 700 performs a process in step S804. On the other hand, if the supply necessity determination portion 701 determines that the signal level is equal to or higher than the second threshold (NO in step S803), the control portion 700 performs a process in step S805.

<Step S804>

If the supply necessity determination portion 701 determines that the signal level indicates a toner density lower than the second threshold, the supply necessity determination portion 701 determines that the toner should be supplied to the developing device 43, and the drive control portion 703 causes the drive motor 350 to operate. Then, the control portion 700 performs the process in step S803 again.

<Step S805>

In step S805, the toner presence/absence determination portion 702 starts taking in the output signal from the light-receiving portion 212. Then, the control portion 700 performs a process in step S806.

<Step S806>

In step S806, the toner presence/absence determination portion 702 determines whether the output signal taken in from the light-receiving portion 212 has a signal level equal to or higher than the first threshold. If the toner presence/absence determination portion 702 determines that the output signal does not have a signal level equal to or higher than the first threshold (NO in step S806), the control portion 700 performs a process in step S807. On the other hand, if the toner presence/absence determination portion 702 determines that the output signal has a signal level equal to or higher than the first threshold (YES in step S806), the control portion 700 performs a process in step S810.

<Step S807>

If the toner presence/absence determination portion 702 determines that the output signal does not have a signal level equal to or higher than the first threshold, the drive control portion 703 causes the drive motor 350 to perform the operation for the cleaning operation. Then, the drive control portion 703 performs a process in step S808.

<Step S808>

The drive control portion 703 determines whether an output signal having a signal level equal to or higher than the first threshold has been received. If the drive control portion 703 determines that a signal level equal to or higher than the first threshold has not been received (NO in step S808), the drive control portion 703 performs a process in step S809. On the other hand, if the drive control portion 703 determines that a signal level equal to or higher than the first threshold has been received (YES in step S808), the drive control portion 703 performs a process in step S811.

<Step S809>

In step S809, the drive control portion 703 determines whether a predetermined time period has elapsed after the drive control portion 703 causes the drive motor 350 to perform the operation for the cleaning operation. If the drive control portion 703 determines that the predetermined time period has not elapsed (NO in step S809), the drive control portion 703 returns to the process in step S808. On the other hand, if the drive control portion 703 determines that the predetermined time period has elapsed (YES in step S809), a process in step S810 is performed.

<Step S810>

If the drive control portion 703 determines that the predetermined time period has elapsed, the toner presence/absence determination portion 702 determines that the toner is present within the toner container 40, and the control portion 700 stores the determination result. Then, the control portion 700 performs a process in step S814.

<Step S811>

If the drive control portion 703 determines that an output signal having a signal level equal to or higher than the first threshold has been received, the drive control portion 703 determines whether the output signal having a signal level equal to or higher than the first threshold has been received a predetermined number of times. If the drive control portion 703 determines that the output signal having a signal level equal to or higher than the first threshold has not been received the predetermined number of times (NO in step S811), the drive control portion 703 performs the process in step S811 again. On the other hand, if the drive control portion 703 determines that the output signal having a signal level equal to or higher than the first threshold has been received the predetermined number of times (YES in step S811), a process in step S812 is performed.

<Step S812>

If the drive control portion 703 determines that the signal level equal to or higher than the first threshold has been received the predetermined number of times, the toner presence/absence determination portion 702 determines that no toner is present within the toner container 40. Then, the control portion 700 performs a process in step S813.

<Step S813>

In step S813, the control portion 700 performs a notification process of providing a notification that the toner is not present within the toner container 40, to prompt replacement of the toner container 40. The notification process is, for example, a process of outputting a predetermined sound through an acoustic output portion which is not shown, or a process of displaying a predetermined message on a display portion which is not shown. Then, the control portion 700 performs a process in step S814.

<Step S814>

In step S814, the operation of the drive motor 350 for the cleaning operation is stopped. Thus, the cleaning operation of the first contact member 651 and the second contact member 652 with respect to the inner surfaces 291 and 292 of the light projection window 221 and the light reception window 222 in the vertical pipe portion 201 is stopped.

As described above, in the present embodiment, the cleaning mechanism 600 which cleans the light projection window 221 and the light reception window 222 is provided. Thus, the toner presence/absence determination portion 702 can be prevented from falsely determining presence/absence of the developer within the toner container 40 due to the toner adhering to the light projection window 221 and the light reception window 222. Therefore, the toner presence/absence determination portion 702 can accurately determine presence/absence of the toner within the toner container 40.

Although the preferred embodiment of the present disclosure has been described above, the present disclosure is not limited to the contents described above, and various modifications can be made.

The image forming apparatus 10 according to the first embodiment has the configuration in which the connection portion 612 and the cleaning member 650 are displaced by using the rotational power of the screw member 205. However, in the image forming apparatus according to the embodiment of the present disclosure may be provided with a drive motor dedicated for displacing the connection portion 612 and the cleaning member 650.

In the image forming apparatus 10 according to the first embodiment, the transmission type optical sensor 210 is used as a sensor for detecting presence/absence of the toner in the vertical pipe portion 201. However, the image forming apparatus 10 may include a reflection type optical sensor as a sensor for detecting presence/absence of the toner in the vertical pipe portion 201, and the light projection window 221 and the light reception window 222 may be provided at the same side in the peripheral wall 220 of the vertical pipe portion 201. In this case, when the toner is present in the vertical pipe portion 201, an output signal having a level equal to or higher than the first threshold is outputted from the light-receiving portion 212. In addition, contact members similar to the first contact member 651 and the second contact member 652 are provided at the side at which the light projection window 221 and the light reception window 222 are provided.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developer guide device comprising:

a conveying pipe portion configured to guide a developer in a predetermined conveyance direction;

a light-emitting portion configured to emit light into an interior of the conveying pipe portion through a light projection window provided in a peripheral wall of the conveying pipe portion;

a light-receiving portion capable of receiving light from the interior of the conveying pipe portion through a light reception window provided in the peripheral wall of the conveying pipe portion;

a cleaning mechanism including a cleaning member configured to receive a predetermined drive force to be displaced thereby to come into contact with inner surfaces of the light projection window and the light reception window to clean the inner surfaces; and a conveying member configured to be rotationally driven about a rotational axis thereof thereby to convey the developer having passed through the conveying pipe portion, wherein the cleaning mechanism further includes a power transmission portion configured to transmit rotational power of the conveying member to the cleaning member to displace the cleaning member, and the power transmission portion converts the rotational power of the conveying member to power in a direction parallel to the conveyance direction and transmits the power to the cleaning member to cause the cleaning member to reciprocate in the direction parallel to the conveyance direction in a state where the cleaning member is in contact with the inner surfaces.

2. The developer guide device according to claim 1, wherein the power transmission portion includes:

an eccentric shaft portion provided at a position eccentric from a rotation center of the conveying member and configured to rotate around the rotation center with rotation of the conveying member; and a connection portion connected at one end thereof to the cleaning member and at another end thereof to the eccentric shaft portion and configured to receive a force from the eccentric shaft portion along with rotation of the eccentric shaft portion to reciprocate in the direction parallel to the conveyance direction.

3. The developer guide device according to claim 2, wherein the light projection window and the light reception window are provided in the peripheral wall of the conveying pipe portion and at positions opposed to each other, the cleaning member includes: a first contact member provided in corresponding relation to the inner surface of the light projection window and configured to come into contact with the inner surface of the light projection window to clean the inner surface; and a second contact member provided in corresponding relation to the inner surface of the light reception window and configured to come into contact with the inner surface of the light reception window to clean the inner surface, and the connection portion includes: a first support portion configured to support the first contact member at a side including the light projection window; and a second support portion configured to support the second contact member at a side including the light reception window.

4. The developer guide device according to claim 2, wherein the cleaning member is a sheet-like elastic member which has elasticity and is contactable with the inner surfaces in a bent state.

5. The developer guide device according to claim 4, wherein the conveying pipe portion has a cylindrical shape, the connection portion includes a base which has a bottom surface connected to the eccentric shaft portion and has a circular truncated cone shape which widens from the bottom surface toward an upstream side in the conveyance direction of the developer in the conveying pipe portion, and the cleaning member is mounted on an outer circumferential surface of the connection portion and at positions corresponding to the light projection window and the light reception window, respectively, and includes a projection portion projecting upward from an upper edge portion of the connection portion.

6. The developer guide device according to claim 1, wherein the cleaning mechanism displaces the cleaning member in the direction parallel to the conveyance direction, between a facing position at which the cleaning member faces the inner surfaces and a retracting position at which the cleaning member has retracted from the facing position.

7. The developer guide device according to claim 1, further comprising:

a determination portion configured to determine whether the conveying pipe portion is in an empty state where the developer is not present in the conveying pipe portion, on the basis of an amount of the light received by the light-receiving portion; and a drive control portion configured to control a predetermined driving source to supply the drive force for causing the cleaning mechanism to perform a cleaning operation, if the determination portion determines that the conveying pipe portion is not in the empty state.

8. The developer guide device according to claim 7, wherein after the cleaning mechanism is caused to perform the cleaning operation, if the determination portion determines that the conveying pipe portion is in the empty state, the drive control portion stops the cleaning operation of the cleaning mechanism.

9. An image forming apparatus comprising:

the developer guide device according to claim 1;

a developer storage portion configured to store the developer therein and capable of supplying the developer to the conveying pipe portion of the developer guide device; and a developing portion configured to supply the developer conveyed by the developer guide device, to a photosensitive body thereby to develop an electrostatic latent image.

* * * * *